United States Patent [19]

Volkert et al.

[11] 4,319,948

[45] Mar. 16, 1982

[54] CARD-AFFIXING APPARATUS

[76] Inventors: Robert B. Volkert, 2940 Iroquois Rd., Wilmette, Ill. 60091; John K. Volkert, 545 Thornwood La., Northfield, Ill. 60093

[21] Appl. No.: 194,473

[22] Filed: Oct. 6, 1980

[51] Int. Cl.[3] ..... B01B 1/00

[52] U.S. Cl. ..... 156/357; 156/566; 156/572; 271/132; 271/165

[58] Field of Search ..... 156/566, 570, 572, 362–364; 271/132, 165; 156/357, 356

[56] References Cited

U.S. PATENT DOCUMENTS

| | | | |
|---|---|---|---|
| 2,991,075 | 7/1961 | Wheeler et al. | 271/165 X |
| 3,839,122 | 10/1974 | Current et al. | 156/357 X |
| 4,179,113 | 12/1979 | Gallimore | 271/132 X |

FOREIGN PATENT DOCUMENTS

| | | | |
|---|---|---|---|
| 2408976 | 4/1975 | Fed. Rep. of Germany | 156/566 |

*Primary Examiner*—David A. Simmons

*Attorney, Agent, or Firm*—Fitch, Even, Tabin, Flannery & Welsh

[57] ABSTRACT

Individualized sequenced sheets are carried along a conveyer to a predetermined location where an adhesive pattern is applied prior to reaching a card-affixing station where a corresponding individualized sequenced card is attached. A reciprocating carriage removes the lowermost card from a stack of cards in a magazine and feeds the card into the nip between a driven squeeze roller and the conveyer whereby the card is affixed via the adhesive pattern.

1 Claim, 5 Drawing Figures

CARD-AFFIXING APPARATUS

The present invention relates to apparatus for assembling related items for mailing and more particularly to apparatus to automatically apply identification cards to accompanying individualized printed sheet material.

BACKGROUND OF THE INVENTION

Direct mail promotional campaigns have been shown to be most effective when they are personalized so that it appears that some effort has been made to particularly recognize the person to whom the material is addressed. A successful promotional device is one which uses a personally printed "temporary identification" card attached to a personally addressed letter. To lessen the cost of such direct mail promotional campaigns, it would be desirable to have automated equipment to apply sequenced "temporary identification" cards or the like to correspondingly sequenced items of individually addressed promotional literature.

Accordingly, it is a primary object of the present invention to provide apparatus for automatically applying sequenced cards to correspondingly sequenced printed personalized sheets.

SUMMARY OF THE INVENTION

Apparatus is provided in which sequenced, individually addressed items are consecutively carried by a conveyer to a predetermined location where an adhesive pattern is applied to each item and then to a card-affixing station where a correspondingly addressed card is affixed via the adhesive pattern. The printed cards are stacked in a magazine, and as each item passes through the card-affixing station, a reciprocating carriage removes the lowermost, corresponding card from the magazine and places it onto the adhesive pattern at a location between the conveyer and a roller which presses the card onto the printed item.

Other objects and advantages will become apparent from the following detailed description of the invention in reference to the accompanying drawings.

DETAILED DESCRIPTION OF THE PREFERRED EMBODIMENT

Figure 1:
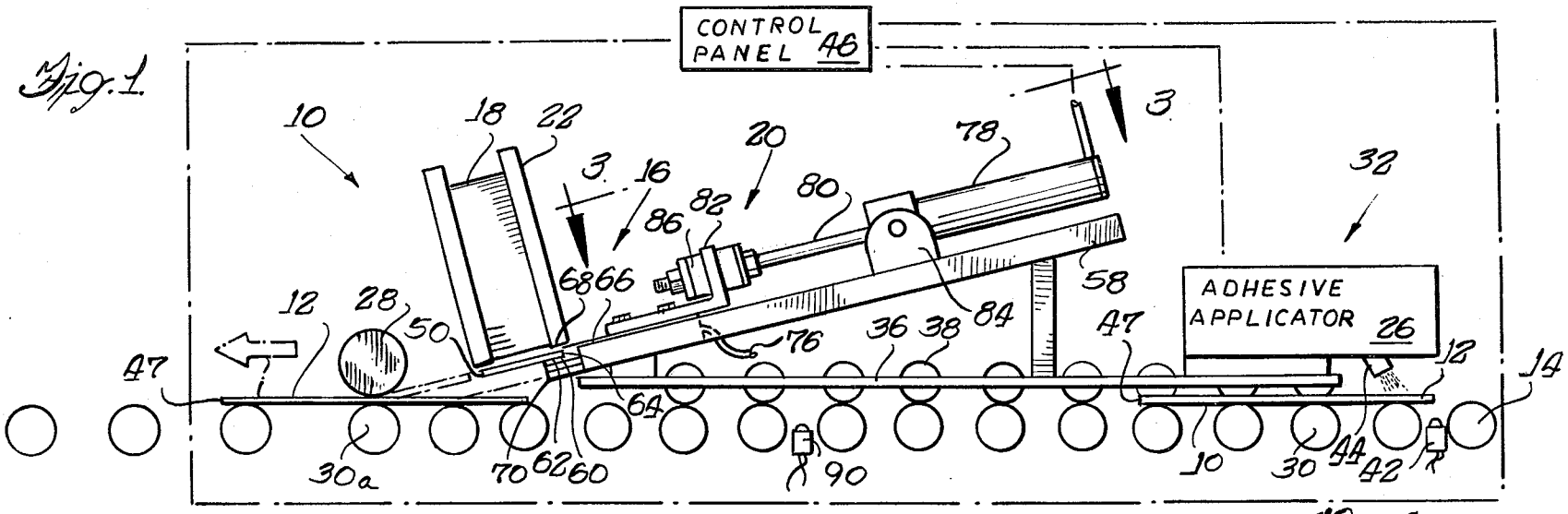
FIG. 1 is a side elevation view of apparatus embodying various features of the invention in which sequenced printed items are carried by a conveyer to a card-affixing station.
Figure 2:
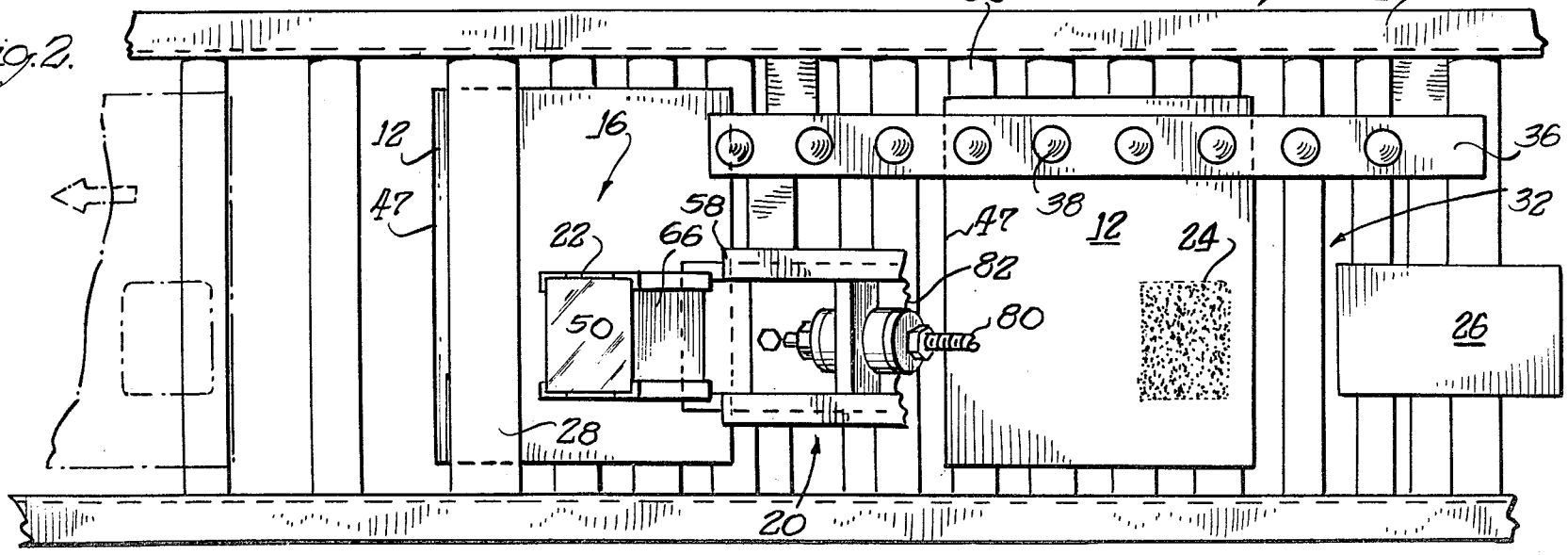
FIG. 2 is a plan view of the apparatus shown in FIG. 1.

To personalize promotional literature, individualized "temporary identification" cards, each with the name of an addressee, are affixed to printed items or sheets of promotional letters printed with the corresponding name and address. The cards and sheets are separately prepared, usually by computer-controlled device from a single mailing list so both sets have the same order of sequence. Apparatus indicated generally at 10 in FIG. 1 is provided whereby sequenced sheets 12, usually personalized letters, are consecutively carried by a conveyer 14 to a card-affixing station 16 where the corresponding card 18 is affixed thereto. A reciprocating carriage indicated generally at 20 removes the lowermost card 18 from a stack of cards contained in a card magazine 22 and slides it forward onto an adhesive pattern 24 (FIG. 2) which has been applied by an adhesive applicator 26 upstream of the card-affixing station 16. As each card 18 is placed upon the adhesive pattern 24 on the sheet 12, the card is simultaneously being fed into the nip between a driven squeeze roller 28 and the conveyer 14 to press the card 18 onto the adhesive pattern 24.

Sequenced sheets 12 are appropriately supplied one at a time to the conveyer 14 which may include a plurality of driven rollers 30. Other conveyers, e.g., a continuous belt, may also be used. The sheets 12 are carried downstream to an adhesive application station indicated generally at 32 where the adhesive applicator 26 sprays or otherwise suitably applies the adhesive pattern 24 thereon. When in the adhesive application station 32 and downstream, the sheets 12 are preferably held in precise position on the conveyer 14 by an overhead ball bar 36 containing a plurality of ball bearings 38 carried by sockets aligned above consecutive rollers 30 of the conveyer. Each ball bearing 38 provides a nip between it and the corresponding roller 30 to firmly position the sheet and hold it flat as it passes therethrough. Each sheet 12 is laterally aligned on the conveyer 14 at the feed station, and additional ball bars (not shown) or other alignment means may be used upstream of the applicator 26 to maintain the lateral position of the sheets on the conveyer. The adhesive pattern is sprayed onto a precise location on each sheet 12 from the overhead adhesive applicator 26 that is actuated by a detector, such as a photoelectric eye 42, which is positioned a predetermined distance upstream of the applicator nozzel 44. When the front edge 47 of the sheet passes over the photoelectric eye, the eye transmits an electrical signal to a control panel 46 (FIG. 1) which after a present time delay actuates the applicator to spray the adhesive pattern 24 onto the sheet.

Figure 3:
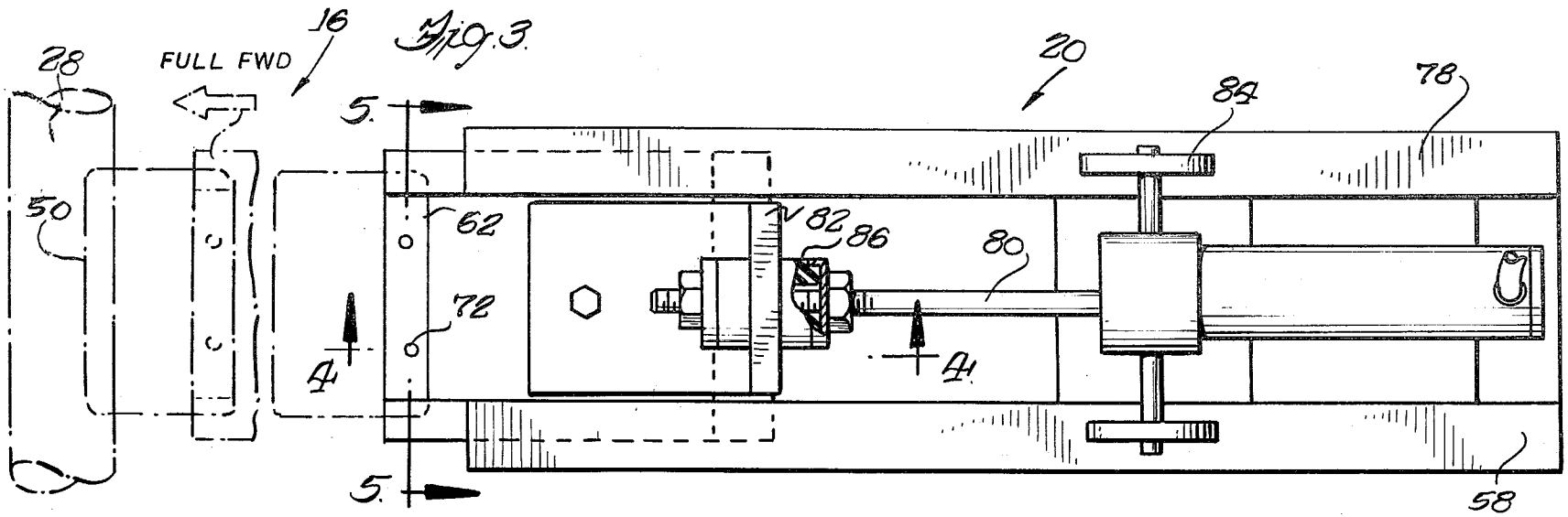
FIG. 3 is a plan view of the reciprocating carriage of FIGS. 1 and 2 which removes a single card from a magazine stack and places it upon the printed item.

The sheet 12 carrying the adhesive pattern is transported by the conveyer 14 immediately to the card-affixing station 16, as best seen in FIG. 3. The carriage 20, which slides consecutive cards 18 from the magazine 22 onto the sheet 12, is supported for reciprocating movement in a plane at an angle of between about 10° and about 25° relative to the plane of the conveyer 14 of the slide the leading edge of each card 18 into contact with the sheet 12. The card magazine 22 extends upward from the track on which the carriage reciprocates.

Figure 5:
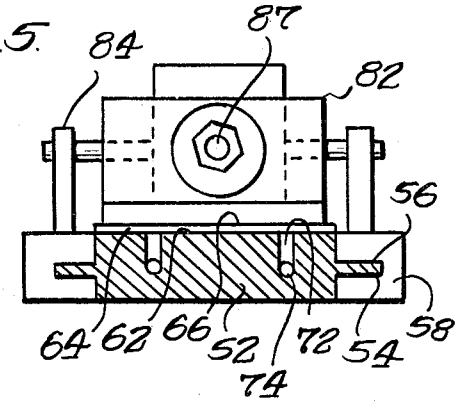
FIG. 5 is a cross-sectional view of the card holder taken along line 5—5 of FIG. 3.
Figure 4:
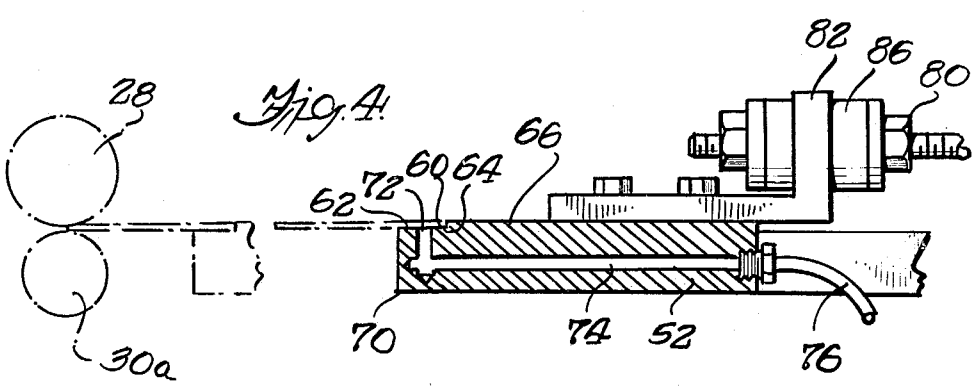
FIG. 4 is a cross-sectional view taken along the line 4—4 of FIG. 3 of the front end of the reciprocating carriage, particularly illustrating the card holder.

The carriage 20 includes a generally rectangular, block-shaped card holder 52, as best seen in FIGS. 4 and 5, having a pair of laterally extending flanges or wings 54 that are received in cooperating grooves 56 of the carriage base track 58. The card holder reciprocates between a retracted position (shown in solid in FIG. 1) where successive cards 18 are picked up one at a time and an extended position (shown in ghost in FIG. 1) where the cards are applied to the sheet 12. A notch 60 is provided in the upper surface at the upper front corner of the card holder 52 creating a generally horizontal card holding surface 62 that terminates at a shoulder or abutment 64 having a height which is substantially the same as or very slightly less than the thickness of each card 18 so that the upper surface of the card holder is substantially coplanar with the upper surface of the lowermost card and does not dislocate the next lowermost card as it reciprocates forward during extension of the carriage 20. The carriage 20 is mounted so that the upper surface 66 of the card holder 52 just clears the bottom end 68 of the magazine 22 as it reciprocates.

In the retracted position where the shoulder 64 of the notch 60 is located behind the magazine 22, the stack of cards 18 indexes downward by gravity so that the lowermost card lies on the card-holding surface 62 which is spaced substantially a one-card thickness below the bottom end 68 of the magazine 22. As the carriage 22 reciprocates to its extended position, the shoulder 64 of the notch 60 pushes the lowermost card 18 forward onto the sheet 12 while the upper surface 66 of the card holder 52 moves below and supports the next successive lowermost card to prevent the stack from indexing downward until the card holder is again in its retracted position. The apparatus 10 herein described is most advantageously used with cards 18 which have sufficient rigidity to hold their shape when slid by the carriage 20 and sufficiently resiliently deformable to resume their shape after being bent slightly during application. Preferably, the cards 18 are formed of thin plastic material.

As best seen in FIG. 3, the card holding surface 62 has a longitudinal dimension which is only a small fraction of the height of the card 18 to allow the front edge 50 of the card to contact the sheet 12 while the lower front edge 70 of the card holder 52 is still spaced slightly above the sheet. The center of gravity of the card 18 is well forward of the front edge of the card holder 52, a pair of suction holes 72 are provided in the card holding surface 62 of the card holder. The suction holes 72 are connected via a passageway 74 through the card holder 52 to a vacuum line 76 which is maintained at a slight vacuum and provides sufficient suction to hold the card against the card holding surface as the carriage 20 moves from its retracted to its extended position even though less than about one-half and preferably less than about one-third of the area of the card is in contact with the supporting surface 62.

The card holder 52 is driven in reciprocating movement along the base track 58 by an air cylinder 78 which extends and retracts a piston rod 80 linked to an angle iron bracket 82 secured to the upper surface 66 of the card holder. The air cylinder is mounted above the carriage base track 58 on a trunnion mount 84 which provides sufficient play for the drive as it reciprocates so that undue stress is not applied to the rod 80. Further play may optionally be provided between the front end of the piston rod 80 and the angle iron 82 by a flexible coupling member 86 received in an aperture in the upper part of the angle iron.

As the sheet 12 enters the card-affixing station 16, it is detected by a second photoelectric eye 90 which transmits an electrical signal to the control panel 46 immediately actuating the cylinder 78 and extending the piston rod 80. By the time the piston rod 80 is in motion, the leading edge of the sheet 12 has entered the nip between one of the conveyer rollers **30*a* and the overhead squeeze roller 28. The stroke of the cylinder is rapid, and when the carriage 30 is fully extended, the leading edge 50 of the card 18 contact the sheet just slightly ahead of the leading edge of the adhesive pattern 24. The positioning of the base tract 58 is such that the card enters the nip between the squeeze roller 28 and the conveyer roller 30*a* at the very end of the stroke of the piston rod 80 to press the card onto the adhesive pattern and pull the card away from its vacuum attachment to the surface 6. Since the card 18 is roller-pressed onto the adhesive pattern 24 from its leading edge 50 progressively rearward, the card is affixed without danger of bending or wrinkling. At the end of the extension stroke of the piston rod 80, air pressure is removed from the cylinder 78 allowing a spring to retract the card holder 52 so that the stack of cards indexes downward to position the next card on the card holding surface 62 in anticipation of the next sheet 12 entering the card-affixing station 16**.

Typical apparatus is capable of applying about 50 to 100 cards per minute, and the card magazine conveniently holds between 200 and 500 cards, thus allowing the operator sufficient time to feed successive batches into the magazine. The letters may be printed on roll stock which is cut and folded before delivery to the conveyer, and of course timing is not a problem. The letters may also be earlier printed and sheeted and then fed to the conveyer by a folding machine.

The invention provides apparatus which precisely locates and applies cards in a predetermined sequenced order to sheets in a corresponding sequenced order to permit the automated application of individualized cards to personalized letters. The apparatus is reliable and insures that the correct card is applied in sequence to the correct sheet because the carriage will pick up and reliably carry one and only one card at a time as it is reciprocated as a result of the arrival of each corresponding sheet.

Modifications obvious to a person having the ordinary skill in the art may be made without departing from the scope of the invention. For example, the apparatus could be used to affix plastic cards bearing a name and an address to a nonpersonalized letter which will be inserted into a window envelope through which the card will be visible. It could be slightly modified to affix a packet of material or a rigid article to a desired substrate. Various features of the invention are emphasized in the following claims.

What is claimed is:

1. Apparatus for affixing a thin plastic card to a direct mail item or the like which carries a matching name, which apparatus comprises, a card-affixing station, a conveyer for moving printed substantially flat items carrying a name and address along a generally horizontal path past and below said card-affixing station, means associated with said conveyer and generally upstream of said card-affixing station for applying an adhesive pattern to said item as it moves along said conveyer, means associated with said adhesive applying means for detecting the arrival of said item upon said conveyer and actuating a spray mechanism to spray said adhesive pattern at a predetermined location upon said moving item, a magazine at said card-affixing station for holding a stack of cards arranged in a sequence that is the same as the sequence of the items being conveyed, card-sliding means including a carriage mounted in a track for reciprocating movement at an angle between about 10° and 25° to said conveyer path, which carriage has a notch in its leading edge defining a card-holding upper surface that terminates in an abutment having a height just slightly less than the thickness of said plastic cards and that is proportioned to contact and support said card over less than one-half its area, and which carriage also has aperture means in said upper surface through which vacuum is applied to hold the under surface of said lowermost card in the stack thereagainst, means for maintaining said direct mail items in substantially flat condition upon said conveyer when said adhesive pattern is being applied, means for reciprocating said carriage back and forth in a straight line between a retracted position and an extended position to remove only the lowermost card in said magazine from said stack and slide it forward and downward, and roller means positioned above said conveyer at said station under which roller means said item passes, said card-sliding means being designed so that said carriage, in its extended position, feeds a leading edge of the lowermost card into the nip between said roller and said conveyer as said portion of said item arrives which carries said adhesive pattern, whereby said card is affixed in a precise location upon the upper surface of a printed substantially flat item carrying a matching name.

* * * * *